United States Patent [19]

Mawla

[11] Patent Number: 4,581,260

[45] Date of Patent: Apr. 8, 1986

[54] ELECTROLESS PLATING METHOD AND APPARATUS

[75] Inventor: Shamil A. Mawla, San Jose, Calif.

[73] Assignee: Ampex Corporation, Redwood City, Calif.

[21] Appl. No.: 654,812

[22] Filed: Sep. 25, 1984

[51] Int. Cl.[4] ..... B05C 3/10; B05D 1/18

[52] U.S. Cl. ..... 427/443.1; 118/416; 118/426; 427/437; 427/438

[58] Field of Search ..... 118/416, 426; 427/437, 427/438, 443.1

[56] References Cited

U.S. PATENT DOCUMENTS 4,447,468 5/1984 Keable ..... 118/416 X

*Primary Examiner*—James R. Hoffman

*Attorney, Agent, or Firm*—Charles M. Carman, Jr.; Harry G. Thibault; Joel D. Talcott

[57] ABSTRACT

An electroless plating bath tank with air sparging and bath heating attachments is provided with a workpiece rack on which multiple horizontal spindles bearing workpieces are rotated about their own axes while also being rotated eccentrically about a horizontal axis, so as to expose the workpiece more uniformly to the action of the bath.

11 Claims, 1 Drawing Figure

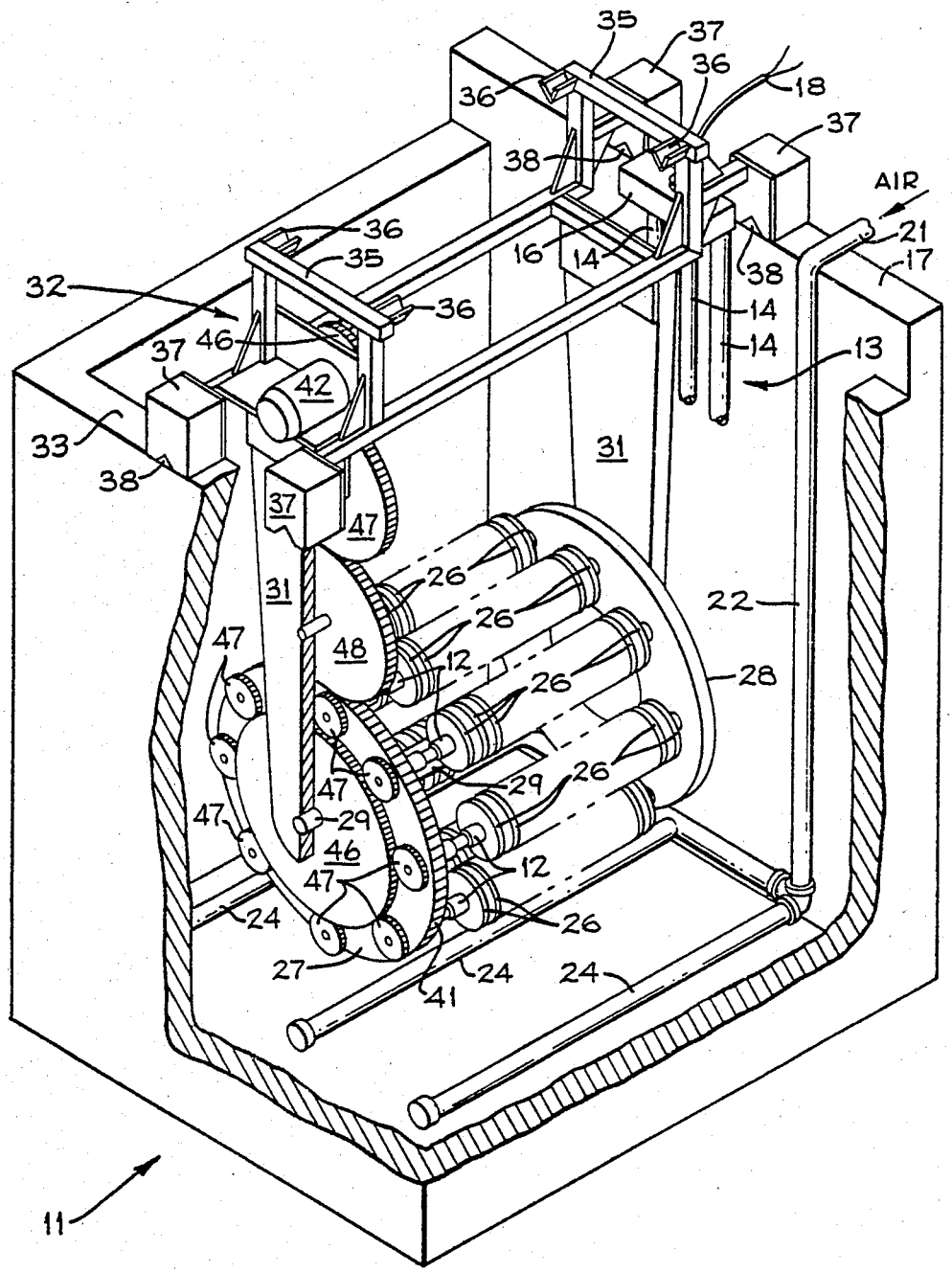
35
37
36
18
36
37
38
AIR
21
17
16
14
38
36
35
32
36
14
14
13
37
46
42
33
31
38
37
47
26
31
22
26
47
48
12
28
26
47
29
26
47
29
46
12
47
24
26
27
24
24
41
11

ELECTROLESS PLATING METHOD AND APPARATUS

BACKGROUND OF THE INVENTION

This invention relates to electroless plating methods and apparatus, and particularly to such methods and apparatus used for plating symmetrical plates.

Electroless plating apparatus typically must perform to highly exacting standards with respect to several critical parameters, and often the failure, by even a slight degree, to meet any of such standards may result in ruined workpieces or non-acceptable quality in the plated pieces.

The electroless plating process is an autocatalytic one, in which the surface of the workpiece, initially, and subsequently the built-up surface of the metal that is being deposited, provides a catalytic surface for the subsequent deposition reaction; consequently any masking of portions of the surface even temporarily, as by unwanted chemical products of the reactions (e.g., acids and precipitates) tends to slow down the deposition process at such points, producing a coating of uneven thickness.

To avoid this eventuality, the present invention contemplates agitating the bath, rotating the workpiece in a bath-agitating manner; and bubbling compressed air from bottom to top through the bath to "sparge" the workpiece surface, i.e., to sweep it clear of unwanted chemicals and to ensure continuous accessibility of the surface to fresh concentrations of bath constituents. In addition the bath is heated, as by immersion heaters or by other types of heaters, to accelerate the plating rate.

The heating action, however, produces a vertical temperature gradient in the solution, hot at the bottom, cooler at the top; also, getting the maximum number of workpieces into the solution requires placing some of the workpieces at higher or lower levels than others in the bath. Consequently, it is desirable that each workpiece be moved bodily and in sequence through both upper and lower portions of the bath, to achieve uniformity of plating action as between workpieces.

In developing the present invention for the nickel-plating of aluminum computer-memory magneticdisc body pieces, it was first attempted to mount the discs in sub-sets on central spindles, and to attach a number of the spindles to a vertically-rotating drum-like structure, so that each spindled sub-set was in turn rotated between top and bottom portions of the bath, as for deposition thereon of a smooth flat nickel surface (about 0.7 mils thick) suitable as a substrate for later deposition of an extremely thin (e.g., less than 5 micro-inch) coating of magnetic material.

However, plating by this method was found to produce, at certain edge portions of each disc, an extremely roughened nickel surface together with imperfect adhesion of the nickel strip to the aluminum base such that, during ordinary handling, bits of the plated nickel often became snagged on hands, gloves or other ambient objects and broke or flaked off; furthermore this edge flaking action often extended around to the face of the disc and tore off bits of the actual substrate upon which the thin magnetic layer had subsequently been plated.

Painstaking investigation eventually identified the cause of this phenomenon: it appears that the sparging bubbles have a tendency to adhere to the "leading edge" of each disc as it moves in its circular orbit around the central shaft; consequently at the site of each such bubble, the nickel deposit has a tiny hole or thin spot, which can be detected by dipping the edge into sulfuric acid, so as to initiate a visible reaction with the underlying aluminum. Conversely, the zones between bubbles may be plated more thickly than otherwise, but are insecurely attached to the aluminum body.

Accordingly, it is an object of the present invention to electrolessly plate disc-like workpieces without imperfect edge plating.

To meet this object the present invention contemplates mounting the workpieces on spindles in a heated and sparged bath, rotating each spindle not only about an eccentric axis, but also its own axis, so that bubbles adhering to the leading edges of the workpieces are quickly swept off, and the edge plating of the pieces is solid, smooth and uniform, with normal adhesion characteristics.

DESCRIPTION OF THE DRAWINGS

The sole FIGURE is a broken-away perspective view of an electroless plating apparatus including the apparatus of the present invention.

DESCRIPTION OF THE PREFERRED EMBODIMENT

Referring now to the sole FIGURE of the Drawing, there is shown a tank 11 for an electroless plating bath adapted, in one use to which the present invention has been put, for electroless plating of a nickel deposition on a plurality of aluminum workpieces each in the form of a thin aluminum disc 26 having a central bore that is meant ultimately to be fitted upon the arbor of a magnetic disc memory machine such as that generally known as a "Winchester" disc machine. Such discs are generally 5.25 inches in diameter. The ultimate electroplated magnetic surface of the disc is to be extremely thin: less than five micro-inches. Such a coating cannot be formed directly upon the aluminum surface, for the aluminum is so soft that ordinary machine-finishing methods usually leave too rough a surface, having peak-to-valley variations greater than the thickness of the magnetic coating. Consequently, the process in which the present invention is used applies to the aluminum surface a 0.0007 inch thick substrate of nickel, which is much harder, is non-magnetic and which is capable of forming and holding an exposed flat surface that is more nearly precisely planar, upon which the ultimate magnetic coating can be more effectively deposited.

The composition of the electroless nickel-plating bath may be any state-of-the-art composition, such as for example, any of those given in Table 1, Page 741, Vol. 8 of "Encyclopedia of Chemical Technology", Third Edition, Dan Wiley & Sons, N.Y., 1979 and abstracted by the Table from U.S. Pat. Nos. 2,532,283 and 2,999,770.

The electroless plating solution (not shown) is supplied in a quantity needed to fill the tank to within a few inches of the top, and is heated by means of an immersion heater 13, comprising say three heating tubes 14 extending downwardly from a mounting box 16 that is hung on the back rim 17 of the tank 11, and is energized as by means of electric current supplied by means not here shown, through leads 18. Alternatively, the tank 11 may have a jacket filled with heated fluid.

To sparge the disc surfaces there is also provided a compressed air bubbling system comprising an inlet conduit 21, which is coupled to a source (not shown) of pressurized air, and to a distribution network of conduits 22, 23 and 24 of which the three ultimate branches 24 lie horizontally on or near the bottom of the tank and are each pierced with numerous pin-hole orifices for the escape of air to form sparging bubbles. These orifices are too tiny to be shown effectively at the scale of the Drawing FIGURE, but it will be understood that they may be directed downwardly and outwardly along radii of the conduits 24 and at angles of about 45 degrees to the vertical, so that they will remain unoccluded when the conduits 24 are resting on the tank bottom.

Also the discs 26 are mounted in impaled fashion upon a set of horizontal spindles 12, here eight in number, and the ends of the spindles are inserted in holders forming parts of a pair of large drum-head wheels 27, 28 for continuous rotation alternately between upper and lower portions of the plating bath, so that the effects of temperature differentials at different levels in the heated bath will be averaged, resulting in the uniform plating of each disc to the same thickness as all the others. The wheels 27, 28 are keyed to a common central shaft 29 for conjoint rotation, and the shaft 29 is journalled in two supports 31 which depend from a rack assembly termed a "flight bar" 32 resting on the front and back rims 33 and 17 of the tank. The front support 31 is shown as broken-away along its vertical centerline for clarity of illustration.

The term "flight bar" connotes the rack's function in the process of inserting the workpieces into the bath and removing them; for this purpose a traveling crane (not shown) is ordinarily used, running on a track behind the back walls 17 of a row of tanks 11, and grasping the rack by four V-shaped elements 36 formed on two upstanding U-shaped portions 35 thereof. When inserting the assembly into the tank, the crane lowers the assembly until four notched support blocks 37 mate with and rest upon four corresponding hard rubber wedges 38 affixed to the front and rear rims 33, 11 of the tank.

To rotate the assembly of spindles 12, one of the wheels 27 is provided with peripheral gear teeth 41, and is driven by a rack-mounted electric motor 42 though a gear train comprising three gears 46, 47 and 48 journalled in the rack and support 31.

To avoid corrosion and other chemical action, the rack 32 is made of stainless steel, and the supports 31, gears 46–48, wheels 27, 28 and other immersed parts, are made from thick slabs of suitable plastic materials, such a polypropylene, polysulfone and polyethylene.

The apparatus so far described was found to be unsuitable, in the state described, for uniform electroless plating of the discs 26 to the rigorous standards required for use of the discs in high-quality computer memories.

When nickel plating of the discs by such apparatus was attempted, it was found that certain parts of each disc edge had an extremely roughened nickel surface together with imperfect adhesion of the nickel layer to the aluminum base, such that during ordinary handling bits of the plated nickel often became snagged on hands, gloves or other ambient objects and broke or flaked off; furthermore this edge flaking action often extended around to the face of the disc and tore off bits of the actual substrate upon which the thin magnetic layer had subsequently been plated.

It appeared that the sparging bubbles had a tendency to adhere to the leading edge of each disc as it moved in its circular orbit around the central shaft; consequently at the site of each such bubble, the nickel deposit had a tiny hole or thin spot, which was detected by dipping the edge into sulfuric acid, initiating a visible reaction with the underlying aluminum. Conversely, the zones between bubbles sometimes were plated more thickly than otherwise, but were insecurely attached to the aluminum body.

It was therefore proposed to rotate the spindles about their own axes, relative to the wheels 27, 28 so as to continuously sweep the bubbles from the disc edges, and to equalize the time spent by each portion of the disc in the leading-edge position.

Accordingly, a sun gear 46 was mounted concentrically with the shaft 29, between the geared wheel 27 and its support 31, but the sun gear was fixed with respect to support 31. Then a set of planetary gears 47 were each keyed to one of the spindles 12 and arranged to mesh with the sun gear 46, so that rotation of the wheel 27 with the spindle assembly caused epicyclical rotation of the discs also about the spindle axes; and this solution proved to be fully effective.

It was incidently found that the sun and planetary gear system functioned more satisfactorily when mounted on the geared wheel 27 that is coupled to the drive train 46, 47, 48, for when the planetary system was coupled to the non-geared wheel 28, a certain amount of play, torsional twisting, and torsional whipping took place between the two wheels 27, 28 resulting in a less-perfect plating quality in the end product.

It should also be recognized that, if the sun gear 46 is not fixed against rotation, but instead is separately driven, then differential variations in the speed of rotation of the discs with respect to the wheels 27, 28 can be produced. Also, the spindles 12, might be loosely journalled in wheels 27, 28 and either eccentrically weighted, or used with non-symmetrical or "dangling" workpieces, in which cases the gears 46, 47 would not be needed.

Thus there has been described an electroless plating method and apparatus for plating the flat surfaces of a set of disc-like workpieces mounted coaxially on spindles and moving in circular orbits orthogonal to the spindles through a sparged and heated plating bath, the discs and spindles being also rotated on their own axes in epicycloidal fashion so as to expose the disc surfaces uniformly to the action of the sparging bubbles.

In effect there is also taught a method for electrolessly plating the faces of plates having axes of rotation normal to the faces, wherein the plates are moved, orthogonally to their axes, at least vertically through a sparged and heated electroless plating solution, and the rotational orientations of the plates, about their axes, are concurrently varied with respect to the direction of movement.

What is claimed:

1. Apparatus for the electroless plating of discs having central openings, comprising:

a bath of electroless plating solution having predetermined constituents, means for heating and sparging said bath, and means for suspending said discs in said bath including a set of elongated spindles impaling said discs by the central openings thereof in subsets wherein the discs have an axially spaced relation, and means for moving said spindles in directions orthogonal to the lengths thereof and in a circuitous path alternately upwardly and downwardly in said bath;

said apparatus also including means for rotating said spindles about the axes thereof to produce an epicycloidal motion exposing all portions of the disc surfaces thereof to substantially identical time-averaged concentrations of heat and of the constituents of said solution.

2. Apparatus as recited in claim 1, wherein said suspension means includes a horizontal shaft and a a pair of wheels keyed for rotation on and with said shaft, said spindles being mounted by the ends thereof between said wheels and in parallel relation to said shaft.

3. Apparatus as recited in claim 2, wherein said epicycloidal rotating means includes a sun gear coaxially mounted with respect to said shaft and a planetary gear keyed to each of said spindles and engaging said sun gear to produce rotation of the spindle with respect to the wheels.

4. Apparatus as recited in claim 3, wherein the sun gear is provided with drive means for rotating the sun gear about its own axis to vary the rotational speeds of the discs and the wheels differentially with respect to one another.

5. Apparatus as recited in claim 3, wherein the sun gear is fixed against rotation.

6. An electroless plating bath apparatus, comprising:
means for heating and sparging said bath;
a pair of parallel spaced supports extending downwardly into said bath;
a shaft and a pair of spindle mounting elements mounted on said shaft for conjoint vertical rotation with said shaft between said supports;
at least one spindle for mounting at least one of said workpieces between said spindle mounting elements for rotation of said spindle in an eccentric orbit centered on said shaft; and
means for driving said shaft and for driving said spindle with respect to said mounting elements to produce epicycloidal motion of said workpiece in said bath.

7. An electroless plating bath apparatus as recited in claim 6, wherein said means for driving said spindle includes a first gear mounted concentrically with said shaft but rotating, if at all, independently with respect thereto, and a second gear keyed to said spindle and engaging said first gear.

8. An electroless bath for plating the flat faces of a thin plate that is symmetrical about an axis normal to said faces, comprising:
first means for rotating said plate in a vertical plane and about said axis in said bath;
second means for rotating said first means in a vertical plane about a second axis that is eccentric to said first-named axis in said bath; and
third means for heating and sparging said bath.

9. A method for electrolessly plating the faces of a plurality of discs, comprising:
heating and sparging said discs in an electroless plating bath;
arranging said discs in a plurality of subsets in each of which said discs are axially spaced apart along a common subset axis;
arranging said subsets in circumferentially and radially equi-spaced relation around and axially parallel to a common horizontal axis;
rotating said subsets about said common horizontal axis in said electroless plating bath, and concurrently rotating each subset about the subset axis in differential and epicycloidal fashion to expose each part of each surface of each disc at least sequentially to substantially the same spaced zones of said bath.

10. A method for electrolessly plating the faces of plates having axes of symmetry normal to said faces, comprising:
providing an electroless plating solution;
heating and sparging said solution;
moving said plates vertically through said solution while maintaining said axes in horizontal orientations; and
concurrently rotating said plates about said axes.

11. A method for electrolessly plating the faces of plates having axes of rotation normal to said faces, comprising:
providing an electroless plating solution;
heating and sparging said solution;
moving said plates orthogonally to said axes thereof and in at least a vertical direction through said solution; and
concurrently varying the rotational orientations of said plates, about said axes thereof, with respect to said direction of movement.

* * * * *